US009174255B2

(12) United States Patent
Diez et al.

(10) Patent No.: US 9,174,255 B2
(45) Date of Patent: Nov. 3, 2015

(54) ENERGY-SAVING ROLLING MILL TRAIN AND ENERGY-SAVING PROCESS FOR OPERATING A COMBINED CASTING AND ROLLING STATION

(75) Inventors: Michael Diez, Erlangen (DE); Norbert Moritz, Erlangen (DE); Günther Winter, Neunkirchen/Brand (DE)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 647 days.

(21) Appl. No.: 13/376,312

(22) PCT Filed: May 31, 2010

(86) PCT No.: PCT/EP2010/057524

§ 371 (c)(1), (2), (4) Date: Dec. 5, 2011

(87) PCT Pub. No.: WO2010/139659

PCT Pub. Date: Dec. 9, 2010

(65) Prior Publication Data

US 2012/0073345 A1 Mar. 29, 2012

(30) Foreign Application Priority Data

Jun. 4, 2009 (EP) ..... 09161954

(51) Int. Cl.

| | |
|---|---|
| ***B21B 35/04*** | (2006.01) |
| ***B21B 35/00*** | (2006.01) |
| *B21B 1/26* | (2006.01) |
| *B21B 1/46* | (2006.01) |
| *B21B 27/02* | (2006.01) |
| *B21B 35/02* | (2006.01) |
| *B21B 15/00* | (2006.01) |

(52) U.S. Cl.

CPC ..... *B21B 35/00* (2013.01); *B21B 35/04* (2013.01); *B21B 1/26* (2013.01); *B21B 1/46* (2013.01); *B21B 27/021* (2013.01); *B21B 35/02* (2013.01); *B21B 2015/0014* (2013.01); *B21B 2015/0057* (2013.01); *B21B 2265/12* (2013.01)

(58) Field of Classification Search

CPC .... B21B 35/04; B21B 35/12; B21B 2035/10; B21B 2203/26; B21B 1/26; B21B 1/46

USPC ..... 72/201, 249

See application file for complete search history.

(56) References Cited

U.S. PATENT DOCUMENTS

| | | | | |
|---|---|---|---|---|
| 5,212,416 | A | 5/1993 | Shimizu et al. | 310/12 |
| 5,542,165 | A | 8/1996 | Coassin et al. | 29/33 C |

(Continued)

FOREIGN PATENT DOCUMENTS

| | | | | |
|---|---|---|---|---|
| CA | 2118295 | A1 | 4/1995 | B21B 31/00 |
| CN | 101259589 | A | 9/2008 | B21B 19/12 |

(Continued)

*Primary Examiner* — Debra Sullivan

(74) *Attorney, Agent, or Firm* — Slayden Grubert Beard PLLC

(57) ABSTRACT

In a rolling mill train (2; 30; 56) for processing rolling stock (4, 32), at least three rolling stands (10) are directly adjacent in the rolling direction and are driven by electric motors (20) having superconducting windings. It is thereby possible to keep the distances between the rolling stands smaller than with conventional electric drives, thus reducing energy losses during the rolling process. A combined casting and rolling station (40), which is equipped with such an electric motor (20) in the rolling stands, is configured and/or operated efficiently in terms of the required heating power.

24 Claims, 5 Drawing Sheets

(56) References Cited

U.S. PATENT DOCUMENTS

| | | | | |
|---|---|---|---|---|
| 6,257,040 | B1 | 7/2001 | Baensch et al. | 72/214 |
| 2002/0152786 | A1 | 10/2002 | Shore | 72/228 |
| 2009/0113971 | A1 * | 5/2009 | Hebert | 72/106 |
| 2012/0073345 | A1 | 3/2012 | Diez et al. | 72/201 |

FOREIGN PATENT DOCUMENTS

| | | | | |
|---|---|---|---|---|
| DE | 4137992 | A1 | 6/1992 | H02K 55/04 |
| DE | 69408595 | T2 | 10/1998 | B21B 1/46 |
| DE | 19911751 | C1 | 6/2000 | B21B 35/15 |
| EP | 0648551 | A1 | 4/1995 | B21B 1/16 |
| JP | 55030336 | A * | 3/1980 | |
| JP | 55073404 | A * | 6/1980 | |
| JP | 62038705 | A | 2/1987 | B21B 1/26 |
| JP | 0313226 | A | 1/1991 | B21B 35/00 |
| JP | 10235416 | A | 9/1998 | B21B 27/02 |
| WO | 96/01710 | A1 | 1/1996 | B22D 11/06 |
| WO | WO 2008136146 | A1 * | 11/2008 | |
| WO | 2010/139659 | A1 | 12/2010 | B21B 35/00 |

* cited by examiner

ENERGY-SAVING ROLLING MILL TRAIN AND ENERGY-SAVING PROCESS FOR OPERATING A COMBINED CASTING AND ROLLING STATION

CROSS-REFERENCE TO RELATED APPLICATIONS

This application is a U.S. National Stage Application of International Application No. PCT/EP2010/057524 filed May 31, 2010, which designates the United States of America, and claims priority to EP Patent Application No. 09161954.4 filed Jun. 4, 2009. The contents of which are hereby incorporated by reference in their entirety.

TECHNICAL FIELD

The invention relates to a rolling mill train, especially a hot rolling mill train, hot wide strip train and/or finishing train of a hot rolling mill, for processing rolling stock, especially consisting of steel, aluminum, copper or titanium, with a plurality of immediately adjacent rolling stands in a rolling direction, with the rolling stands each having at least two working rolls, between which the rolling stock is able to be processed. The invention also relates to a combined casting and rolling station, to a process for operating a combined casting and rolling station and to a process for operating a combined casting and rolling station.

BACKGROUND

Metallic feedstock such as slabs, hot strip or cold strip, sheet metal, tubes etc. made from material such as iron, steel, non-ferrous metals or other metallic materials are subjected on a large industrial scale to various stages of processing and refinement. Typical processing stages are the rolling out of cast slabs into hot strip or the rolling down of the hot strip to the thickness desired by the customer in a cold rolling mill train, for example a tandem mill train.

Conventionally rolling mills occur as separate systems which receive their rolling stock for example from a separate continuous casting system. In modern combined casting and rolling stations hot strip can be manufactured in a continuous process, especially as an endless strip. A combined casting and rolling station is disclosed for example in WO 96/01710 or in DE 694 08 595 T2.

The decisive component for processing rolling stock is a rolling stand, with which for example slabs can be rolled into a strip in consecutive rolling passes. Rolling stands are used in practically all rolling mill trains, especially in hot strip rolling trains and cold strip rolling trains.

After the hot rolling the strips can be subjected to further processing steps. At the end of the rolling train the rolled-down strip is usually rolled up into coils with the aid of a coiler. As an alternative there is a direct coupling to a cold rolling station and/or processing line in the continuous process.

The hot strip can be subjected to further intermediate steps, such as heat treatment for example, before it is conveyed to a cold rolling mill train. At the end of a cold rolling mill train there is usually a winding coiler for receiving the rolled strip combined with shears if necessary in the continuous process.

During rolling high torques must be applied for processing the rolling stock. For this reason powerful electric motors are used to drive the rolls, the torque of which is frequently further increased with the aid of a reduction gear. DE 199 11 751 C1 describes a drive device for a rolling stand. Powerful electric motors as well as suitable transmissions are very heavy and voluminous.

The electric motors complete with gearing must—relative to the processing direction of the rolling stock—be arranged to the side, which means that they significantly increase the area to be occupied by a fabrication shop. As an alternative to this JP 10-235416 proposes integrating a compact superconducting electric motor into the inside of a roll of a rolling stand. Such an embodiment results in mechanical problems since the roll concerned, with its stability thus reduced, will suffer deformations with high rolling forces.

SUMMARY

According to various embodiments, a rolling mill train for processing rolling stock and a combined casting and rolling station with such a rolling mill train as well as an operating process for the combined casting and rolling station and a method for improving the performance of a rolling mill train can be specified, which by means of its/their drive concept, simplify the metallurgical and production processes during rolling, improve their energy efficiency and/or are able to be designed in a more flexible manner.

According to an embodiment, a rolling mill train, especially a hot rolling mill train, hot wide strip rolling mill train and/or finishing train of a hot rolling mill, for processing rolling stock, especially consisting of steel, aluminum, copper or titanium, comprises a plurality of rolling stands immediately adjacent to one another in a rolling direction, wherein the rolling stands each have at least two working rolls between which the rolling stock is able to be processed, comprising a number of electric motors with superconducting windings arranged to the side next to the rolling stands, wherein, for at least three or at least four of the rolling stands, at least one of the working rolls in each case is connected to the shaft of one of the electric motors.

According to a further embodiment, at least one of the working rolls may have no gearing or is connected to the shaft of one of the electric motors by gearing reduced in size by comparison with a conventional electric drive. According to a further embodiment, two of the working rolls can be mechanically coupled via a branching transmission, wherein the branching transmission is connected on the drive side to the shaft of one of the electric motors. According to a further embodiment, the electric motors, especially the electric motors of neighboring rolling stands, may have a common cooling system. According to a further embodiment, at least two of the rolling stands can be designed for maximum rolling force of more than 1500 t, especially of more than 3000 t or more than 4000 t, and are at a distance from one another of less than 5.0 m, preferably less than 4.5 m or less than 4.0 m. According to a further embodiment, an open-loop and/or closed-loop control device may be provided, especially for controlling a heating device, a finishing section, a cooling section and/or a speed of the rolling mill train, being embodied such that a reduced heat loss of the rolling stock as a result of the superconducting electric motors used compared to a use of conventional motors is taken into account. According to a further embodiment, a transport device can be present between the rolling stands which is embodied as a vertical looper.

According to another embodiment, a combined casting and rolling station for continuous production of hot strip with a rolling mill train—arranged downstream from a caster—as described above.

According to a further embodiment of the combined casting and rolling station, the combined casting and rolling station is without heating device for heating the strip cast by the caster. According to a further embodiment of the combined casting and rolling station, the combined casting and rolling station may comprise a heating device arranged before or after the rolling mill train for heating the strip cast by the caster, with the heating device, as regards its heat output, being configured to take into account a reduced heat loss in the rolling stock or strip as a result of the electric motors used.

According to yet another embodiment, in a method for operating a combined casting and rolling station as described above, rolling stock—preferably made of steel—can be transmitted with a mass throughput ($\dot{m}$) through the rolling mill train and with the heating device able to be operated with a heat output in accordance with:

$$P<k\cdot\dot{m}$$

wherein the following applies for the factor k: k=0.14 (MW·h/t), especially k=0.13 (MW·h/t), k=0.12 (MW·h/t) or k=0.11 (MW·h/t).

According to yet another embodiment, in a method for increasing the performance of an existing rolling mill train comprising at least one rolling stand with a non-superconducting motor drive and one arranged in a restricted space, the non-superconducting motor can be replaced by an electric motor not exceeding the space restriction with superconducting windings, which is designed such that the maximum rolling torque in the rolling stand is increased compared to the existing rolling mill train.

BRIEF DESCRIPTION OF THE DRAWINGS

The invention is explained in greater detail below with reference to exemplary embodiments shown in the drawing, in which.

DETAILED DESCRIPTION

Figure 1:
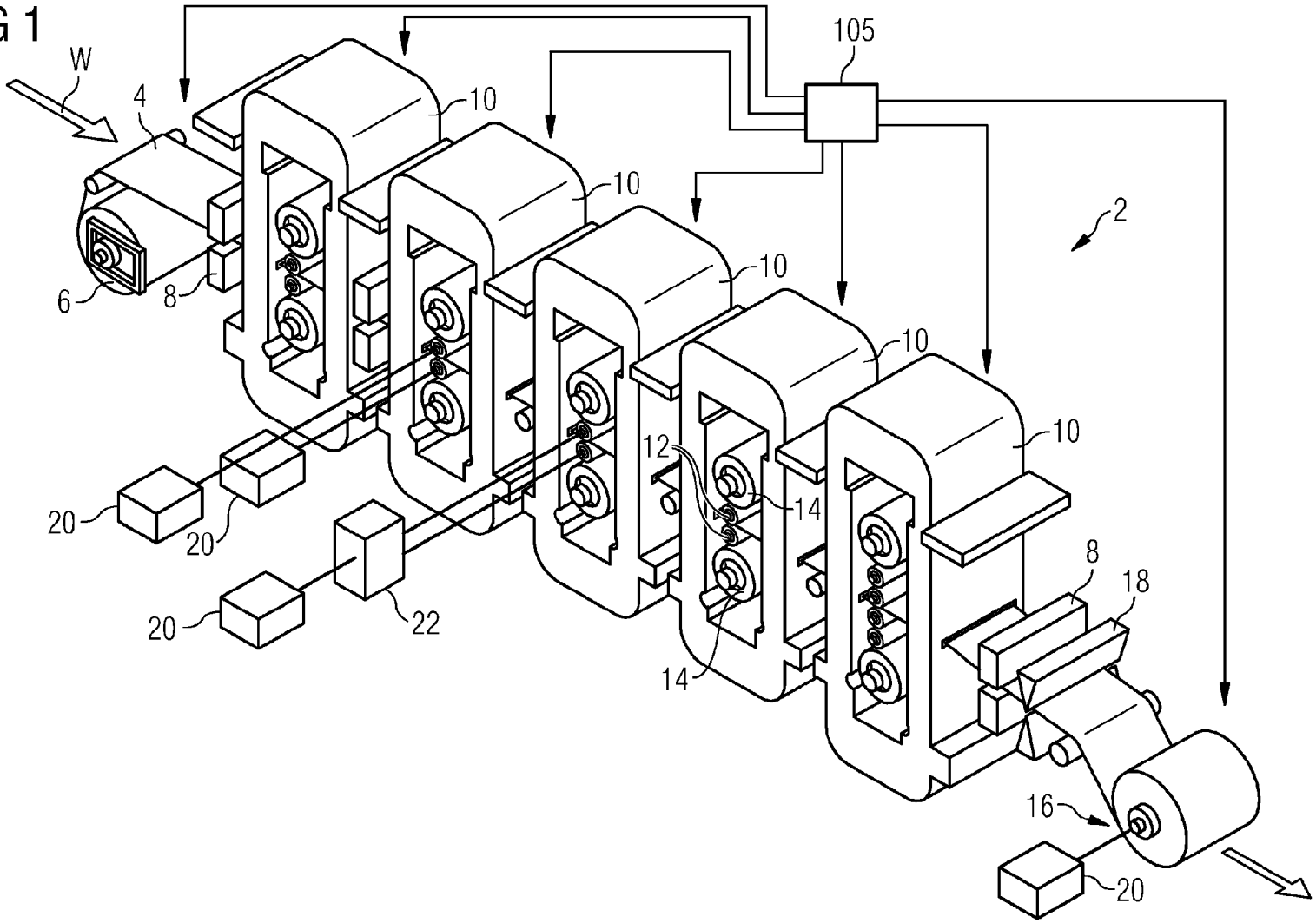
FIG. 1 shows a cold rolling tandem mill train in a schematic perspective view.

The rolling mill train comprises a plurality, especially at least three or four, rolling stands immediately adjacent in the rolling direction, especially in tandem operation.

The rolling train is either a roughing train and—especially advantageously—a finishing train of a hot rolling mill or hot strip rolling mill.

In such cases the rolling train comprises a number of electric motors arranged to the side with superconducting windings and in at least three or at least four of the rolling stands at least one of the working rolls in each case is preferably connected without any gearing to the shaft of one of the electric motors.

The rolling stock involved is typically slabs, hot strip, cold strip, rough or fine sheet metal, tubes etc. made of iron, steel, non-ferrous metals such as aluminum for example.

An electric motor with electric superconducting windings will be referred to below by the abbreviation HTS motor. An HTS motor is to be understood both as a machine of which the rotor winding is superconducting and the stator winding is normally-conducting and also as a machine, so-called fully superconducting machines, in which both the rotor and also the stator winding is manufactured using superconducting material. The considerations underlying the various embodiments of the rolling mill train are as follows:

In a rolling mill train high-power or torque is needed which can only be delivered by correspondingly large/voluminous electric motors. These must frequently be provided with gearing for increasing the torque. Accordingly the drives are of a large size. The large spatial extent of gearing and motor as well as their great weight results in the construction of a compact rolling mill train previously only being possible to a restricted extent.

For example the resulting space requirement for previously used conventional electric motors has produced distances between rolling stands which have had to be bridged in an undesired way by devices for material transport. A further consequence of the large distance between rolling stands are throughput times between the reshaping passes which, specifically in a hot rolling process, lead to significant and undesired temperature losses. In the example given this then results in the product spectrum having to be restricted somewhat in respect of the end thickness still able to be rolled and/or in the productivity (throughput) being reduced.

It has been recognized that the rolling stands in a rolling mill train, as the result of the spatial extent of rolling stand, gearing and electric motors, must maintain a minimum space between them, the minimum space between the rolling stands is restricted by the size of the rolling stands, by any transport devices which might be required between the stands, by electric motors or gearing. By using rolling stands which are driven by an HTS motor the minimum distance between directly adjacent rolling stands and thus for example the undesired cooling down of the rolling stock can be reduced by reduced thermal radiation.

According to various embodiments, it has been recognized that these technical problems can be overcome by using HTS motors, which have a significantly reduced size compared to conventional electric motors of the same power. It has also been recognized that the use of an HTS motor in a rolling mill brings with it significant potentials for energy-saving (lower power dissipation) and also cost advantages on account of possible reduced distance between units. This is of particular advantage in combined casting and rolling stations.

The rolling stands of the rolling mill train have at least two working rolls between which the rolling stock is able to be processed, with at least one of the working rolls able to be driven by an HTS motor. Such a rolling stand is able to be used both in hot rolling and also cold rolling mill trains. While it is used in a hot rolling mill train for example to roll out slabs, a rolling stand in a cold rolling mill train is used to roll down hot-rolled strip to the thickness required by customers. The rolling stand can for example be designed as a duo or as a quarto rolling stand or as a sexto rolling stand.

Since the rolling stand is driven by a more compact HTS motor with the same power, smaller spaces can be chosen between the rolling stands and the overall rolling train can thus be shorter or more compact in its construction. According to various embodiments, it has been recognized that use of an HTS motor in the rolling mill thus brings with it significant cost reductions and also technological benefits as a result of a reduced cooling down of the rolling stock passing through the stand.

An HTS motor has a more stable, rigid operating behavior (e.g. smaller rotor displacement angle) and by comparison with a conventional electric motor also reacts more quickly to changes in guidance variables. This situation frequently occurs during rolling. By comparison with a conventional electric motor an HTS motor is also able to be regulated more quickly, which especially in its use in a rolling mill train, allows an improved and/or faster pass behavior and/or an improved ski regulation. This is especially advantageous in heavy hot rolling reversing trains. "Ski" refers to an undesired deformation of the strip upwards or downwards, i.e. perpendicular to the direction of transport.

In accordance with a further development at least one of the working rolls is connected to the shaft of one of the electric motors without any gearing or by means of smaller gearing when compared to conventional electrical drives. In other words in the first variant the mechanical connection between the shaft of the HTS motor and the working roll of the rolling stand is made without torque-converting mechanical intermediate elements (gearing). For example the shaft of the electric motor can be connected to the working roll via a common shaft or a spindle. A spindle is to be understood for example as a double-jointed shaft with two universal joints on its ends, which is used for transmitting the torque between the working shaft of the motor and the working roll of the rolling stand. Dispensing with gearing not only brings with it a cost benefit but also increases the reliability and the variability of the rolling stand. In accordance with the characteristic of the HTS motor of being able to provide an increased torque compared to a conventional motor of comparable size—as a second variant—the size of the gearing can be reduced. The two variants allow the cost of the overall system to be reduced. The variant without gearing is lower-maintenance.

A specific configuration of the rolling stand in which the HTS motor is advantageously used in accordance with various embodiments are the so-called twin drives, in which each of the working rolls is driven by an electric motor. Correspondingly, in accordance with a further embodiment, the rolling stand is designed so that said stand comprises a number of HTS motors, with each of the working rolls—preferably as described above, directly or with reduced gearing—being mechanically connected to the shaft of one of the HTS motors. Since by comparison with conventional electric motors the HTS motors have a smaller size for the same torque, e.g. as a result of a smaller stator diameter, the spacing between the drive shafts of the motors in relation to one another can be reduced. A noticeable positive aspect of this is the fact that at the same time the existing inclination of the spindles can be reduced or with the inclination of the spindles remaining the same the torque of the motors can be increased. By a reduction in the spindle inclination their wear, especially in the universal joints, can be reduced. As a third measure/variant the spindle length can also be reduced, which results in improved regulation behavior, since long spindles act like springs.

With a twin drive the electric motors are arranged directly alongside one another or located above one another (offset in relation to one another). In accordance with a further embodiment these motors thus advantageously have a common cooling system.

The use of HTS in turn is therefore not only advantageous for directly-driven rolling stands, such as the aforementioned twin drives, but also for a rolling stand which in accordance with a further embodiment comprises two working rolls which are coupled mechanically via a branching transmission, wherein said transmission is coupled on the drive side to the shaft of one of the electric motors. In accordance with a development the branching transmission involves a comb rolling gear since this withstands high torques.

The material of the windings of the HTS motor, in accordance with a further embodiment, comprises LTC (=Low Temperature Conducting) material. Bismuth-based superconductor material is suitable for example, which is technically proven, resistive and thus easy to process. The superconductor material for the windings of the HTS motor can be selected so that this has a critical current density of more than 300 A/mm$^2$ at an operating temperature of 4.2 K.

To reduce the cooling outlay it is expedient for the material of the windings of the HTS motor to contain metal-oxidic HTC superconductor material (HTC=High Temperature Conducting). YBCuO is typically suitable as HTC superconductor material, which has a higher transition temperature than metal-oxidic LTC superconductor material. The cooling outlay for operating an HTS motor with windings made of HTC superconductor material is thus correspondingly smaller.

Preferably an operating temperature of between 10 and 40 K, preferably between 20 and 30 K, is thus provided for the windings of the HTS motor. In the said temperature range metal-oxidic HTC super conductor material also exhibits a high critical current density and a high critical field.

Especially advantageously, in accordance with a further embodiment, the HTS motors, especially those of adjacent rolling stands, have a common cooling system.

With continuous hot rolling mill trains in particular the distance between the rolling stands causes undesired changes in the state variables of the rolling stock. The distance between stands in current hot rolling mills with conventional construction typically amounts to more than 5.0 m to 5.5 m. As a result of such distances the rolling stock can for example cool down too greatly between the individual rolling passes or scale can form on the surface. Such effects must be compensated for by additional units such as an induction oven and for example and a descaling unit. The use of such additional units and also their integration into the rolling mill train is expensive on the one hand and resource-intensive on the other.

The distance between the rolling stands can be reduced by the use of drive motors with superconducting windings, whereby additional units e.g. for descaling or for heating up the rolling stock, can be dispensed with.

In accordance with a form of embodiment, on the rolling mill train, at least two of the rolling stands are designed for a maximum rolling force of more than 1500 t, especially of more than 2000 t, more than 2500 t, more than 3000 t, more than 3500 t or more than 4000 t, and here these two rolling stands have a spacing between them in the rolling direction of less than 5.0 m, preferably of less than 4.5 m, less than 4.3 m, less than 4.0 m, less than 3.9 m, less than 3.7 m or less than 3.5 m.

The distance between the rolling stands is defined in this case as the distance between the axes of rotation of the working rolls of adjacent rolling stands in the rolling direction.

The rolling mill train also preferably has a control and/or regulation device—embodied for example as a part of the process automation—especially for controlling a heating device, a cooling path, a finishing section and/or a speed of the rolling mill train which is embodied such that a reduced heat loss in the rolling stock as a result of using the HTS motors as opposed to using conventional motors is taken into account. This can be done by implementation in an underlying model. It is especially expedient to take account of the reduced heat loss in the process automation system of the finishing section among other things in the regulation to the finished strip temperature and/or to the coiler temperature.

Preferably an optional transport device—if necessary present between the rolling stands—is embodied as a vertical looper. In this way a further reduction in the rolling stand spacing is achieved.

In accordance with a further embodiment the rolling mill train is part of a combined casting and rolling station for continuous production of hot strip. The speed of processing of a combined casting and rolling station is determined by the speed of the caster. The changes in the state of the rolling stock occurring between the individual rolling passes, for example its cooling down, can consequently not be compensated for in a simple manner by an increase in the rolling speed. According to various embodiments, it has been recognized that a reduction in the spacing between the rolling stands thus represents a very advantageous opportunity of effectively avoiding intermediate units, such as descaling units or induction ovens for example or designing them less expensively. A reduced spacing between the rolling stands can be achieved by the use of HTS motors.

Preferably in the combined casting and rolling station which has a heating device arranged before or after the rolling mill train for heating up the strip cast by a caster, the heating device can be configured as regards its heating output to take account of a reduced heating loss in the rolling stock or the strip as a result of the electric motors used.

In extreme cases the combined casting and rolling station can be designed entirely without such a heating device.

According to other embodiments, in a method for operating a combined casting and rolling station, rolled or strip material—preferably made of steel—with a mass throughput ($\dot{m}$ as mass per unit of time) is transported through the rolling mill train and wherein the heating device is equipped with a heating power (P) and/or driven in accordance with:

$$0 \leq P < k \cdot \dot{m}$$

with the following applying for the factor k: k=0.14 (MW·h/t), especially k=0.13 (MW·h/t), k=0.12 (MW·h/t) or k=0.11 (MW·h/t). In this case MW stands the megawatts, h for hours and t for (metric) tonnes.

According to yet further embodiments, in a method for improving the performance of an existing rolling mill train comprising at least one rolling stand with a non-superconducting motor drive and one that is arranged in a restricted space, the non-superconducting motor is replaced by an HTS motor not exceeding the limits of the available space, i.e. an electric motor with superconducting windings, which is designed so that the maximum rolling torque in the rolling stand is improved relative to the existing rolling mill train. Either only the rotor is designed to be superconducting or only the stator, or both.

A tandem cold rolling mill train 2, as shown in FIG. 1, is used for rolling down the hot strip 4 to the thickness required by customers. For this purpose the hot strip 4 of the tandem cold rolling mill train 2 rolled into a coil is fed with the aid of an uncoiler 6 in a rolling direction W. The thickness of the hot strip 4 is initially determined with the aid of a measuring device 8, subsequently the strip is rolled down to the desired thickness in a number of consecutive rolling passes with the aid of rolling stands 10. Each of the rolling stands 10 has at least two working rolls 12 and two support rolls 14, wherein the rolling stock, in this case the hot strip 4, is processed between the working rolls 12, at the end of the rolling process the strip is again rolled into a coil with the aid of a coiler 16. To separate the strip across the rolling direction W a cut-to-length shear 18 is available. The coiler 16 is driven by an HTS motor 20. The shaft of the HTS motor 20 is connected directly to the axis of the coiler 16, i.e. no gearing is used between the HTS motor and the coiler 16. The same applies to the drive of the uncoiler 6 not shown in FIG. 1. The working rolls 12 of the rolling stands 10 are either driven as twin drives, shown for example for the second rolling stand 10 in the rolling direction W or using a branching drive, in this case a comb shaft drive 22, as shown for example for the third rolling stand 10 in the rolling direction W. With the rolling stand 10 embodied as a twin drive both working rolls 12 are linked directly in each case to the shaft of a respective separate HTS motor (both labeled 20). The working rolls 12 are thus driven directly, with reduction gearing being dispensed with.

As an alternative, as is shown for the following rolling stand 10 in the rolling direction, the working rolls can be driven via the comb shaft transmission 22, which in its turn is connected on the drive side to a (here only single) HTS motor 20.

The coiling and uncoiling 16, 6, as well as the rolling stands 10 are connected to a common open-loop and or closed-loop control device 105 which will be described in detail later.

Figure 2:
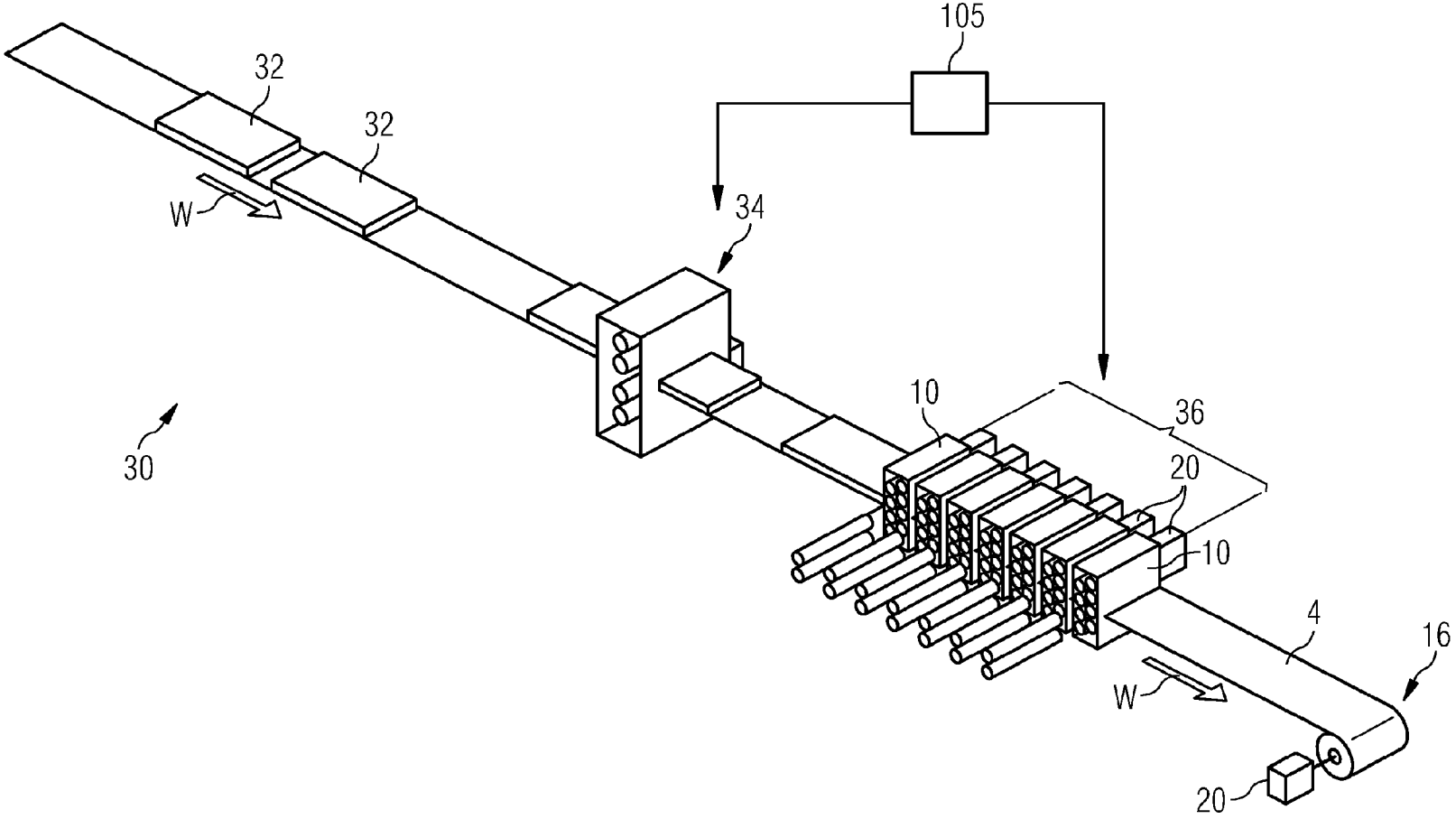
FIG. 2 shows a schematic diagram of a hot rolling mill train in a perspective view.

FIG. 2 shows a hot rolling train 30 with which preheated slabs 32 rolled out into hot strip 4. For this purpose the slabs 32 rolled out in a preliminary train 34 and later with a finishing station (finishing train) 36 consisting of several (here: seven) rolling stands 10 into hot strip 4. This is rolled up with the aid of a coiler 16 into a coil. The individual rolling stands 10, which each have a design similar to that depicted in FIG. 1 of two working rolls 12 and two support rolls 14, are driven both in the preliminary train 34 and also in the finishing station 36 by HTS motors 20. The same applies for the coiler 16. The rolled strip has a width of 0.6 m to 1.8 m, typically 0.8 m to 1.6 m. the working rolls can be up to 5.5 m wide (=measured along the axis of rotation).

In the two aforementioned exemplary embodiments the HTS motors 20 are arranged to the side in relation to the rolling direction W and at the sides of the rolling stands.

Figure 3:
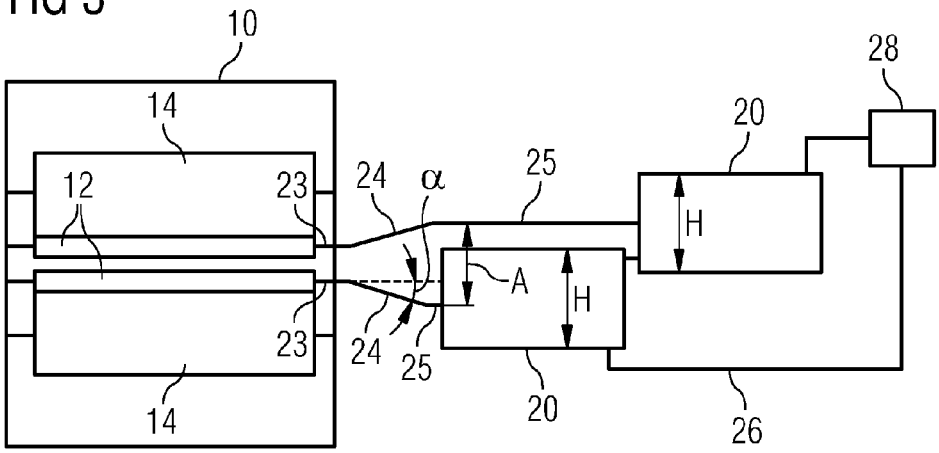
FIG. 3 shows a twin drive of a rolling stand in a schematic cross-sectional view.

FIG. 3 shows a highly schematic (vertical) cross-sectional view of a rolling stand 10 of the tandem cold rolling mill 2 of FIG. 1 or—especially preferably—of the hot rolling mill train 30 of FIG. 2, of which the working rolls 12 are driven with a twin drive. For this purpose each of the working rolls 12 is connected with it shaft 23 via a spindle 24 to the motor shaft 25 of an HTS motor 20. The connection between the shaft 23 of the working rolls 12 and the spindle 24 and also between this and the motor shaft 25 is made in each case with the aid of a universal joint or by means of shafts with claws. Compared to conventional electric motors otherwise used for twin drives, the HTS motors 20 shown in FIG. 3 have a lower height H. This leads to the distance A between the motor shafts 25 being smaller than with conventional drives and thus the spindle inclination $\alpha$ only being slight. The spindle inclination $\alpha$ is to be understood as the angle between the spindle 24 and the extension of the shaft 23 of the working rolls 12. The spindle inclination $\alpha$ is produced from the offset between the shaft 23 of the working roll 12 and the motor shaft 25, which is bridged by the spindle 24. Preferably the spindle inclination $\alpha<3°$, e.g. 1.5°-2.5°.

The HTS motors 20 have a shared cooling system 26 with which their superconducting windings are cooled. The cooling system 26 involves an insulated pipe system generally known from cryo technology, in which a coolant is circulated and into which a cooling unit 28 is integrated. This normally includes a reservoir for the coolant which can for example be liquid helium, neon, nitrogen or a mixture of these gases. The cooling unit 28 also includes a compressor or a cooling head for vaporizing the coolant. The coolant can be circulated in the cooling system 26 with the aid of a pump or can be driven by a thermo-siphon effect.

Figure 4:
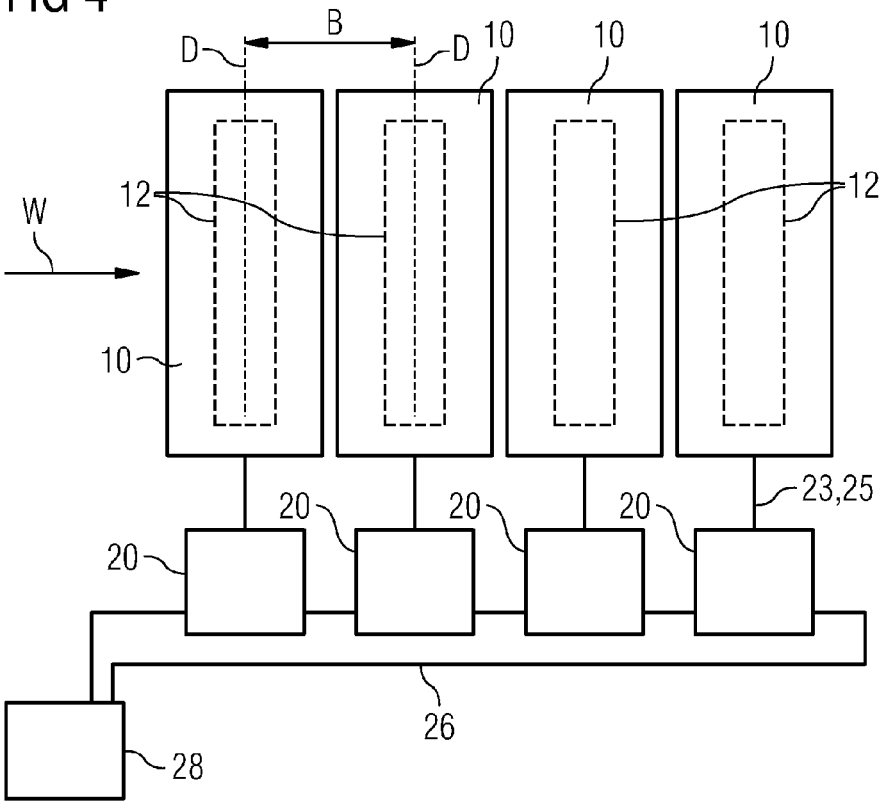
FIG. 4 shows a schematic tandem rolling mill train in a (cutaway) overhead view.

FIG. 4 shows a schematic diagram of four rolling stands 10 of a hot strip finishing train of a rolling mill designed in a tandem arrangement, as is typically shown in FIG. 2 as the finishing section 36 of the hot rolling train 30, in a (sectional) view from above. The rolling stands 10 are arranged directly adjacent to one another, omitting any further units such as for example induction heaters or descaling systems in the rolling direction W, which is made possible by the compact size of the HTS motors 20 used to drive them. The rolling stands 10 can in this case achieve a spacing B from one another which is not possible with conventionally driven rolling stands 10. In this case the distance between the axes of rotation D of the working rolls 12 in the rolling direction W is defined as the spacing B.

The working rolls 12 are driven directly by the HTS motors 20, i.e. the shaft 23 of the working roll 12 and the motor shaft 25 of the HTS motors 20 form a common component. The HTS motors 20 of the rolling stands 10 arranged directly alongside one another has a common cooling system 26 with an integrated cooling unit 28.

As a result the more compact design and narrower footprint the heat losses are considerably reduced. This can advantageously be taken into account in a cooling model running in a higher-ranking control system for the rolling train (not explicitly identified) for influencing the metallurgical changes in the rolling stock during the rolling.

Figure 5:
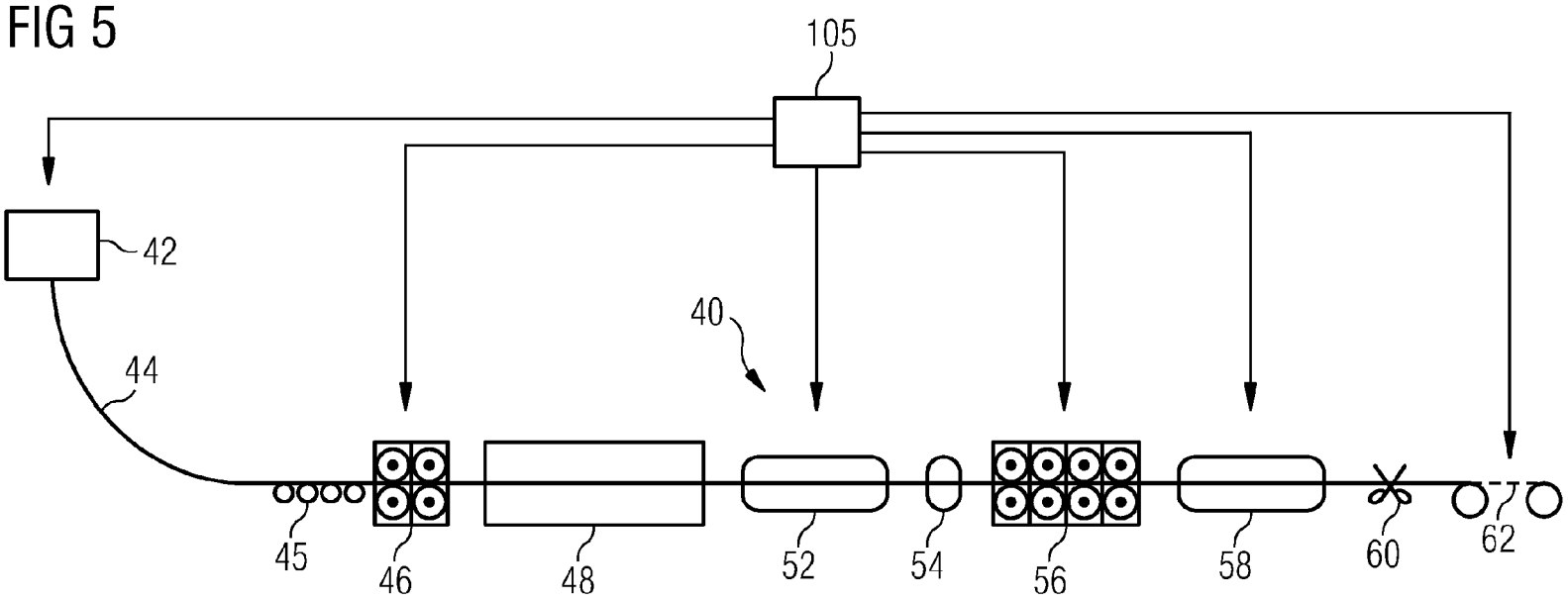
FIG. 5 shows a schematic diagram of the combined casting and rolling station.

FIG. 5 shows a combined casting and rolling station 40 with endless strip production, in which, starting from a casting platform 42 in a thin slab casting device 44, thin slabs are continuously created, which via a roll path 45 continuously, i.e. without cutting, coiling and intermediate storage, are conveyed to a first rolling train 46 (high reduction mill). The motors of this rolling train 46 are embodied as HTS motors. The same applies to the drives of the subsequent optional device 48 for separation and or onwards conveyance, which can include a pendulum shear and a plate pusher. This device 48 is of the special significance for subsequent operational disruptions occurring in the finishing direction. An optional cropping shear can also have an HTS drive.

There follows a heating device 52, a descaling device 54, a second rolling train (finishing mill) a cooling section 58, an end shear 60 for cutting to the desired product line and also a coiling device 62 for the finished product (coil). The drives of the rolls of the second rolling train 56 are designed as HTS motors which, as in the case of the rolls of the first rolling train 46, results in particular space advantages.

The correspondingly compact and short design either enables devices for supplying additional heat (e.g. bar heater) in order to avoid an undesired early cooling off of the strip, to be dispensed with entirely, or all the corresponding devices to be dimensioned smaller than they would be without the use of HTS motors. In FIG. 5 for example an induction oven 54 is shown as a heating device, of which the heat output P—for the same mass throughput—is selected smaller than with conventional electric motors. For a mass throughput $\dot{m}$ of 180 tonnes of steel per hour (t/h) its heat output P=25 Megawatt (MW), preferably amounts to only 23 MW or only 19 MW.

The various embodiments not only have effects on the dimensioning of a rolling station but also on the control of the station and its components. Thus an open-loop or closed-loop control device 105 (FIGS. 1, 2, 5) of the rolling train 2, 30, 46 or 56 or of the combined casting and rolling mill 40 for controlling a heating device 52, a finishing section 56, a cooling section 58 and/or a speed of the rolling mill, is embodied such that a reduced heat loss as a result of the superconducting electric motors as opposed to use of conventional motors is taken into account.

Figure 6:
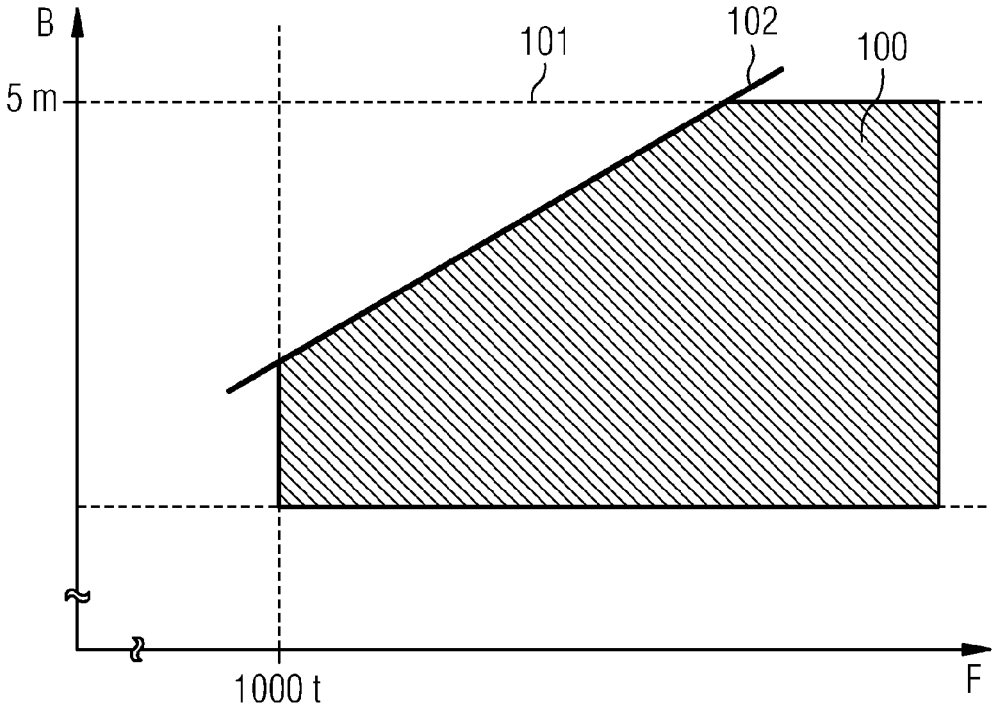
FIG. 6 shows a rolling force stand distance diagram.

FIG. 6 shows in the cross-hatched area 100 an embodiment of rolling trains, for example of finishing sections of a hot wide rolling station, with the distance B in the rolling direction of two rolling stands being specified on the vertical axis and the maximum rolling force F able to be generated by the rolling stands being plotted to the right. "Small systems" with a maximum rolling force of less than 1000 t (metric tonnes) are not considered in the example. Rolling stand distance B is less than 5 m even with very large rolling forces (line 101) according to various embodiments. The straight-line 102 illustrates the knowledge that with increasing rolling force ever more space is needed for the drive systems and motors, because said devices must work against increasing forces in the rolling gap so that ultimately the rolling stand distance increases.

The straight-line 102 can be described by the following equation:

$$B\max = a + Fb$$

with a=2 m, b=1 m/1000 t
or a=2.5 m, b=1 m/2000 t
or a=0 m, b=1 m/500 t

According to various embodiments, i.e. with the use of one or more HTS motors, for a specific rolling force F to be exerted by the rolling stand the distance B between the rolling stands is selected smaller than the value for Bmax produced by the formula:

$$B = B\max - c$$

with c=0.4 m, 0.6 m, 0.8 m, 1.0 m, 1.2 m or 1.4 m.

Figure 7:
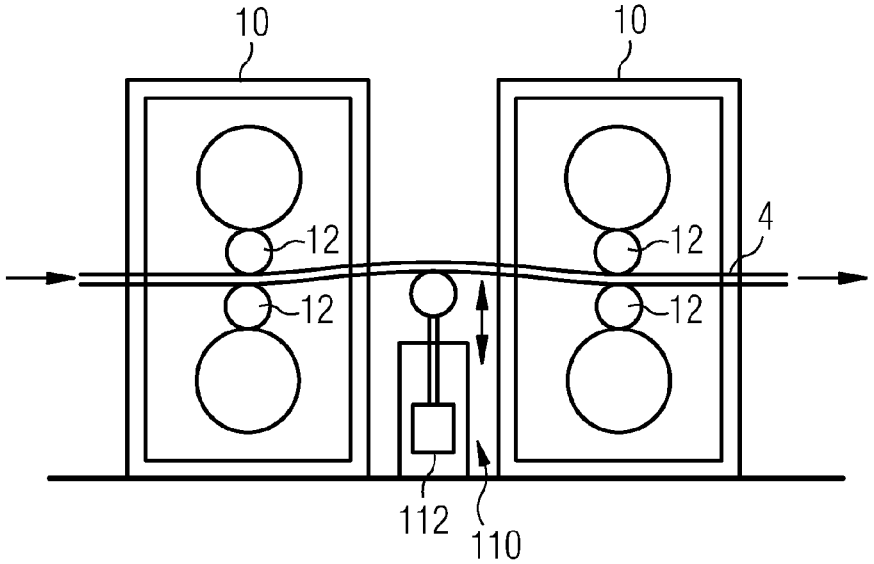
FIG. 7 shows a rolling stand design with looper in a schematic longitudinal section.

FIG. 7 shows an optional design for further reduction of the Rolling stand distance B in which a loop 110 is present as a transport device between two rolling stands 10. An adjustment cylinder 112 essentially only performs a vertical or up-and-down movement to support the strip 4 and thus needs very little space.

What is claimed is:

1. A rolling mill train for processing rolling stock, comprising a plurality of rolling stands immediately adjacent to one another in a rolling direction, wherein each rolling stand includes at least a first working roll and a second working roll for processing the rolling stock, a plurality of electric motors with superconducting windings arranged to a side next to the rolling stands, wherein, for a first one of the rolling stands, a first one of the plurality of superconducting electric motors is connected only to the first working roll of the first rolling stand to drive only the first working roll of the respective rolling stand and a second one of the plurality of superconducting electric motors is connected only to the second working roll of the first rolling stand to drive only the first working roll of the first rolling stand, such that each of the first and second superconducting electric motors is connected to exactly one working roll, the first and second electric motors being arranged on the same lateral side of the first rolling stand, and wherein for a second one of the rolling stands, both the first and second working rolls of the second rolling stand are mechanically coupled via a branching transmission that is connected to a shaft of a single one of the electric motors, such that the single electric motor drives both the first and second working rolls of the second rolling stand.

2. The rolling mill train according to claim 1, wherein at least one of the working rolls has no gearing or is connected to a shaft of one of the electric motors by gearing reduced in size by comparison with a conventional electric drive.

3. The rolling mill train according to claim 1, wherein the plurality of electric motors have a common cooling system.

4. The rolling mill train according to claim 1, wherein at least two of the rolling stands are designed for maximum rolling force of more than 1500 metric tonnes and are at a distance from one another of less than 5.0 m.

5. The rolling mill train according to claim 1, wherein a transport device is present between the rolling stands which is embodied as a vertical looper.

6. The rolling mill train according to claim 1, wherein the rolling mill train is at least one of a hot rolling mill train, hot wide strip rolling mill train and finishing train of a hot rolling mill.

7. The rolling mill train according to claim 1, wherein the rolling stock consists of steel, aluminum, copper or titanium.

8. The rolling mill train according to claim 1, wherein the the electric motors of at least two neighboring rolling stands have a common cooling system.

9. The rolling mill train according to claim 1, wherein at least two of the rolling stands are designed for maximum rolling force of more than 3000 metric tonnes or more than 4000 metric tonnes, and are at a distance from one another of less than 4.5 m or less than 4.0 m.

10. The rolling mill train according to claim 1, comprising an open-loop or closed-loop control device for controlling at least one of a heating device, a finishing section, a cooling section, and a speed of the rolling mill train, wherein the control device is configured to account for a reduced heat loss of the rolling stock associated with the superconducting electric.

11. The rolling mill train according to claim 1, wherein each of at least three of the rolling stands includes at least one working roll that is driven by one of the plurality of electric motors with superconducting windings.

12. The rolling mill train according to claim 1, wherein:

for a particular one of the plurality of rolling stands that includes first and second working rolls driven by first and second superconducting electric motors, respectively, which are arranged on a common side of the particular rolling stand:

the first superconducting electric motor is connected to the first working roll by a first mechanical connection comprising a first shaft, the second superconducting electric motor is connected to the second working roll by a second mechanical connection comprising a second shaft, and wherein the first superconducting electric motor is arranged between the second superconducting electric motor and the first working roll along a longitudinal direction parallel to an axis of rotation of the first working roll, such that the second shaft extends adjacent the first superconducting electric motor along a length of the first superconducting electric motor extending in the longitudinal direction.

13. The rolling mill train according to claim 12, wherein:

the second mechanical connection between the second superconducting electric motor and the second working roll comprises the second shaft and a spindle, and the angle defined between the spindle of the second mechanical connection and the first shaft of the first mechanical connection is between 1.5 degrees and 2.5 degrees.

14. The rolling mill train according to claim 12, wherein:

the second mechanical connection between the second superconducting electric motor and the second working roll comprises the second shaft and a spindle, and an angle defined between the spindle of the second mechanical connection and the first shaft of the first mechanical connection is less than 3 degrees.

15. A combined casting and rolling station for continuous production of hot strip, the combined casting and rolling station comprising:

a caster configured to cast a strip, and a rolling mill train arranged downstream from the caster and configured receive the strip from the caster in a continuous cast-and-roll process, the rolling mill train comprising:

a plurality of rolling stands immediately adjacent to one another in a rolling direction, wherein each rolling stand includes at least two working rolls for processing the strip cast by the caster, and a plurality of electric motors with superconducting windings arranged to a side next to the rolling stands, and wherein for a particular one of the rolling stands, both the first and second working rolls of the second rolling stand are mechanically coupled via a branching transmission that is connected to a shaft of a single one of the electric motors, such that the single electric motor drives both the first and second working rolls of the particular rolling stand.

16. The combined casting and rolling station according to claim 15 without a heating device for heating the strip cast by the caster.

17. The combined casting and rolling station according to claim 15, comprising a heating device arranged before or after the rolling mill train for heating the strip cast by the caster, wherein the heating device is configured to account for a reduced heat loss in the strip as a result of the superconducting electric motors of the rolling mill train.

18. The combined casting and rolling station according to claim 15, wherein, for at least one of the rolling stands, at least two superconducting electric motors are connected to the at least two working rolls of the rolling stand, the at least two electric motors being arranged on the same lateral side of the rolling stand.

19. The combined casting and rolling station according to claim 15, wherein the branching transmission comprises a comb shaft drive.

20. A method for operating a combined casting and rolling station, the method comprising:

providing a combined casting and rolling station comprising:

a caster configured to cast a strip;

a rolling mill train downstream from the caster and comprising:

a plurality of rolling stands immediately adjacent to one another in a rolling direction, wherein each rolling stand includes at least two working rolls for processing the strip cast by the caster, at least one electric motor with superconducting windings arranged to a side next to the rolling stands, the at least one electric motor connected to at least one of the working rolls of the rolling mill train; and a heating device arranged before or after the rolling mill train and configured to heat the strip;

transmitting the strip with a mass throughput ($\dot{m}$) through the rolling mill train; and operating the heating device with a heat output in accordance with:

$$P<k\cdot\dot{m}$$

wherein P represents a heating power, and k is a constant with a value between 0.11 (MW·h/t) and 0.14 (MW·h/t).

21. The method according to claim 20, wherein the rolling stock is made of steel.

22. The method according to claim 20, wherein k=0.14 (MW·h/t) or k=0.13 (MW·h/t).

23. The method according to claim 20, wherein k=0.12 (MW·h/t) or k=0.11 (MW·h/t).

24. A combined casting and rolling station for continuous production of hot strip, the combined casting and rolling station comprising:

a caster configured to cast a strip, and a rolling mill train arranged downstream from the caster and configured receive the strip from the caster in a continuous cast-and-roll process, the rolling mill train comprising:

a plurality of rolling stands adjacent to one another in a rolling direction, wherein each rolling stand includes at least two working rolls for processing the strip cast by the caster, and a plurality of superconducting electric motors arranged to a side next to the rolling stands, wherein a first electric superconducting motor and a second superconducting electric motor are connected to the first and second working rolls, respectively, of a particular rolling stand, and wherein the first and second superconducting electric motors, which are connected to the first and second working rolls of the particular rolling stand, partially overlap each other along a direction parallel to the axis of rotation of the first working roll, such that a collective width of the first and second superconducting electric motors along a width direction perpendicular to the axis of rotation of the first working roll is less than a sum of a width of the first superconducting electric motor and a width of the second superconducting electric motor along the width direction.

* * * * *